US010566156B1

(12) United States Patent
Kowalik et al.

(10) Patent No.: US 10,566,156 B1
(45) Date of Patent: Feb. 18, 2020

(54) COMMUNICATION SYSTEM CONTROLLED MOTORIZED IN-LINE DISCONNECT SWITCH WITH IMPROVED LOCK OUT SYSTEM

(71) Applicant: CLEAVELAND/PRICE INC., Trafford, PA (US)

(72) Inventors: Peter M. Kowalik, Trafford, PA (US); Joseph K. Andreyo, Irwin, PA (US)

(73) Assignee: CLEAVELAND/PRICE INC., Trafford, PA (US)

( * ) Notice: Subject to any disclaimer, the term of this patent is extended or adjusted under 35 U.S.C. 154(b) by 0 days.

(21) Appl. No.: 16/383,615

(22) Filed: Apr. 14, 2019

Related U.S. Application Data

(60) Provisional application No. 62/722,852, filed on Aug. 25, 2018.

(51) Int. Cl.

| | |
|---|---|
| ***H01H 31/08*** | (2006.01) |
| ***H01H 31/00*** | (2006.01) |
| ***H01H 31/02*** | (2006.01) |
| ***H01H 31/34*** | (2006.01) |

(52) U.S. Cl.
CPC ..... *H01H 31/08* (2013.01); *H01H 31/006* (2013.01); *H01H 31/026* (2013.01); *H01H 31/34* (2013.01); *H01H 2221/068* (2013.01)

(58) Field of Classification Search
CPC .... H01H 31/08; H01H 31/006; H01H 31/026; H01H 31/34
USPC ..... 200/43.16
See application file for complete search history.

(56) References Cited

U.S. PATENT DOCUMENTS 5,072,082 A * 12/1991 Kowalik ..... H01H 1/54 218/23
6,984,795 B1 * 1/2006 Kowalik ..... H01H 31/28 200/48 CB
7,026,558 B1 * 4/2006 Andreyo ..... H01H 3/227 200/17 R (Continued)

OTHER PUBLICATIONS

U.S. Appl. No. 16/271,795, filed Feb. 9, 2019, Peter M. Kowalik, et al.

(Continued)

*Primary Examiner* — Edwin A. Leon
*Assistant Examiner* — Iman Malakooti
(74) *Attorney, Agent, or Firm* — Ronald S. Lombard

(57) ABSTRACT

A communication system controlled motorized in-line high voltage air break disconnect switch with a lock out system including a communication device remote controlled lock out. Also a mechanical lock out is provided if a battery that powers the remote controlled lock out is not functioning or other unforeseen problems cause a failure of the switch or the remote controlled lock out to operate. The remote controlled lock out when operative can prevent the switch from operating the motor when the remote controlled lock out is actuated. The motorized switch typically includes the motor having a worm drive shaft carrying a hookstick eye ring. The remote controlled lock out includes a locking gear mounted on the drive shaft. A lockout lever having a locking tooth is provided that engages or disengages the locking gear when appropriately actuated by the remote control to lock or unlock the switch blade drive motor.

22 Claims, 9 Drawing Sheets

(56) References Cited

U.S. PATENT DOCUMENTS

| | | | | |
|---|---|---|---|---|
| 7,122,986 | B1 * | 10/2006 | Willard | H01H 33/36 318/468 |
| 9,881,755 | B1 | 1/2018 | Cleaveland | |
| 9,966,207 | B1 | 5/2018 | Cleaveland | |
| 2004/0173576 | A1 * | 9/2004 | Kowalik | H01H 33/124 218/154 |
| 2013/0284575 | A1 * | 10/2013 | Rhein | H01H 31/30 200/48 SB |

OTHER PUBLICATIONS

Cleaveland/Price Inc. Bulletin DB-1021B11, entitled "Type ILO-C Hookstick Operated In-Line Transmission Switch 69 kV-230 kV 1200 A.", 4 pages.

* cited by examiner

COMMUNICATION SYSTEM CONTROLLED MOTORIZED IN-LINE DISCONNECT SWITCH WITH IMPROVED LOCK OUT SYSTEM

CROSS-REFERENCE TO RELATED APPLICATION

This application claims the benefit of U.S. Provisional Application No. 62/722,852 filed Aug. 25, 2018, which is incorporated herein by reference in its entirety.

BACKGROUND OF THE INVENTION

The present invention relates generally to an air break disconnect switch for high voltage electrical applications and, more particularly, to a communication system controlled motorized in-line high voltage air break disconnect switch that mounts in-line with the transmission line conductor without the need of a group operated switch with associated ground supported mounting structure. Such a communication system controlled motorized in-line high voltage disconnect switch hangs from and is supported by its associated transmission line. In particular, the present invention is directed to a novel system for locking out such a switch for safety reasons.

One example of a non-communication system controlled non-motorized in-line high voltage disconnect switch is a vertical break disconnect switch currently manufactured and sold by Cleaveland/Price Inc., of Trafford, Pa., the present Assignee, as a type ILO-C, Hookstick Operated In-Line Transmission Switch. The switch is described in Cleaveland/Price Bulletin DB-1021611, entitled "Type ILO-C Hookstick Operated In-Line Transmission Switch 69 kV-230 kV 1200 A.". The switch is rated 69 kV-230 kV, 1200 amperes. The Cleaveland/Price Inc. type ILO-C In-Line high voltage disconnect switch utilizes a manually operated hookstick for engaging an operating eye ring attached to the breakjaw end of the switch blade of the switch. The hookstick when engaged with the operating eye ring imparts rotation to the hinge end of the switch blade for opening and closing of the switch. The Cleaveland/Price Inc. type ILO-C In-Line high voltage disconnect switch is a single phase switch and is versatile and can serve many functions on a three phase system. The switch can be used to sectionalize long transmission lines, disconnect lines from substations, serve as a line tap switch, and serve as a temporary maintenance switch, for example. The Cleaveland/Price Inc. type ILO-C In-Line high voltage disconnect switch saves significant installation costs compared to a non-in-line switch installed via direct ground support mounting structure. The Cleaveland/Price Inc. type ILO-C high voltage disconnect switch allows for easy, cost efficient sectionalizing of high voltage transmission lines and isolation in high voltage substations. As a result of this, the type ILO-C In-Line high voltage disconnect switch has been used by electric utilities for many years to isolate transmission and substation circuits.

U.S. Pat. No. 9,881,755 B1 by Charles M. Cleaveland and issued to Cleaveland/Price Inc., the present assignee, on Jan. 30, 2018, discloses a communication system controlled in-line motorized high voltage disconnect switch. The switch includes an elongated strain insulator supporting an elongated rotating switch blade having a hinge contact end and a break jaw contact end. The rotating switch blade is rotatable about a hinge pin at the hinge contact end during opening and closing of the switch. The switch includes a motor connected to an output shaft to cause the hinge end of the switch blade to rotate when energized to open or close the switch. A communication system actuates the motor to cause the switch to open and close as desired. The communication system may include a number of communication devices. The Cleaveland/Price Inc. patent discloses embodiments of a vertical break and a side break in-line motorized high voltage disconnect switch. Both the vertical break and side break switches include an elongated switch blade that is rotatable at one end of the switch blade, i.e., about the hinge end.

Reference is also made to U.S. Pat. No. 9,966,207 B1 by Charles M. Cleaveland and issued to Cleaveland/Price Inc., the present assignee, on May 8, 2018, which also discloses a Motorized High Voltage In-Line Disconnect Switch With Hand-Held Communication System To Prevent Unwanted Operation. The switch includes a rotating switch blade that is operated by a communication system controlled motor that may include a switch mounted communication device, such as a radio which is controlled by another such communication device located in a hand-held portable controller that is battery powered to provide a secure way to open and close the switch without traditional padlockable manual operators that are vulnerable to terrorist attack. The switch is battery operated and solar charged.

Another such communication system controlled in-line motorized high voltage disconnect switch is disclosed in U.S. patent application Ser. No. 16/271,795 filed Feb. 9, 2019, by Peter M. Kowalik and James R. Shychuck, and assigned to the present Assignee, Cleaveland/Price Inc., and entitled "In-Line Motorized Double Break Disconnect Switch". This invention discloses a high voltage motor operated in-line double break disconnect switch suspended by an electric power line conductor wherein the switch includes a horizontally rotating switch blade, that is suspended by a motor output shaft attached to the midpoint of the blade of the switch blade to balance the blade. A communication system is disclosed for controlling the motor that may include a switch mounted communication device such as a radio which may be controlled by another such communication device located at a distance and powered by a solar charged battery or alternatively controlled by a hand-held controller.

The said U.S. Pat. No. 9,881,755 B1 and U.S. Pat. No. 9,966,207 B1 and U.S. patent application Ser. No. 16/271,795 are each incorporated herein by reference in their entireties as though fully set forth.

Padlocks are commonly used by utilities on high voltage air break disconnect switches as lock out devices. They are used to prevent high-voltage disconnect switches from being opened or closed. These disconnect switches are generally located in a substation or equivalent area and may have either manual operation through swing handles or handcrank gearboxes or may have remote operation through motor operators. The lock out devices, such as padlocks, are purely mechanical in nature. They may use mechanical locks with plungers that prevent motion of the switches when the plunger is extended. Such locks are operated by a special key that can only be removed from another lock when that lock is in correct position to release the key. There are also mechanical locks that slide and release a vertical operating pipe of one switch while locking the vertical operating pipe of another associated switch. This allows one switch to operate only while the second switch is in a particular position. As can be seen, lock out locks and interlocks are critical to the safe operation of many of the disconnect switches on an electric utility system. While doing maintenance on the transmission line switches are locked open using a padlock on a vertical operating pipe to provide safety for working personnel.

The above-referenced communication system controlled in-line motorized high voltage disconnect switches as disclosed in the said U.S. Pat. No. 9,881,755 B1 and the said U.S. Pat. No. 9,966,207 B1 and U.S. patent application Ser. No. 16/271,795 all hang on a utility's power line, i.e., in-line, and have no connection with the ground below to allow for lock out operation. These new versions of disconnect switches are battery powered and are commanded to operate by radio/remote control, either from a supervisory control and data acquisition (SCADA) communication system or a hand held transmitter in close proximity to the switch. This type of switch has many advantages over the prior art style of switch that needs an area of ground, foundations, supporting structures, fences, padlocks for lockout and is accessible to terrorists or other malcontents. These new versions of disconnect switches are commanded by secure encrypted radio signals and require a bucket truck to physically reach them.

One issue that both the above-referenced communication system controlled in-line motorized high voltage disconnect switches and the prior art style of switch have in common is the need to be locked out to prevent accidental or unintended operation. Utilities using the new versions, i.e., communication system controlled in-line motorized high voltage disconnect switches will not necessarily want to travel to the switch location in a bucket truck to lock out the switch using a hot stick to engage a locking device. It is therefore an object of the present invention to provide a lock out system that can securely lock out the switch blade of the switch from movement, especially one that prevents an open switch from closing, and that can be operated by remote control. This is critical to the safe use of the new versions of switch. It is a further object of the present invention to provide a manual operation aspect of the lock out system in the event an onboard battery for powering a lock out motor has failed or other unforeseen issues cause a failure of the switch or the remote control feature of the lock out to operate.

SUMMARY OF THE INVENTION

The present invention provides a lock out system for a communication system controlled in-line motorized high voltage disconnect switch that can safely and securely lock out the switch blade of the switch from operational movement, especially one that prevents an open switch from closing. The lock out system of the present invention may be operated by wireless remote control for safe use of the switch for the purpose of locking the switch open so maintenance can be done on the utility line that must remain unenergized while utility workers are in contact with the line, for example.

The lock out system includes mechanical, electrical and electronic devices that combine to provide a secure lock out feature for the switch that has no fixed operating capability from the ground and may be operated by remote control. The lock out system of the present invention includes a separate dedicated locking, or lockout, motor powered by the switch battery. The lock out system is used to operate a physical locking lever that prevents rotation of the switch blade drive motor. The locking lever prevents rotation of the switch blade by engaging a gear attached to the switch blade drive motor drive shaft preventing an open switch from closing. The locking motor is remotely commanded through the same communication system as is used to initiate switch operation, but is given a distinctly different message to operate the locking lever to lock or unlock the switch compared to the switch blade drive motor communication device message. This communication device message, like the communication device messages used to initiate the main switch operation, can be created at and sent from a SCADA control center to remotely operate the lock out or can be sent from a hand held transmitter whose accessibility is securely controlled by a utility company. Also a "locked out" status message can then be sent from a disconnect switch mounted long range communication device to a control room communication device to verify correct operation of the lock out feature of the present invention. The locking motor may be provided with a micro switch arrangement to control the travel of the locking motor. When the locking lever is in the locked position, the switch blade drive motor is also preferably electrically disconnected from the switch battery. To accomplish this, the locking lever may be provided with a magnet which upon rotation of the locking lever into the locked position, a magnet sensor senses the magnet and actuates a magnet sensor switch which electrically disconnects the switch blade drive motor from the switch battery.

In the event the switch battery is not functioning or other unforeseen issues cause a failure of the switch or the lock out to operate, the utility will then need to send a bucket truck crew to the switch to manually operate the switch and lock out lever with a hot stick. The referenced prior art disconnect switch, such as disclosed in U.S. Pat. No. 9,881,755 B1, already includes a manual operating feature, i.e., a hot stick eye ring which is located at the end of the switch blade drive motor drive shaft, that allows the switch to be opened or closed with a hot stick, also known as a hookstick, operated by a utility worker. One aspect of the lock out system of the present invention for manual operation provides that to access the hot stick "eye ring", a safety cover must now be flipped open first with the hot stick. Flipping open the safety cover operates a safety switch of the lockout system which electrically disconnects the switch motor from the battery. This ensures that the switch motor can not start to rotate the eye ring and so the switch cannot operate while a utility worker is using the hot stick to turn the "eye ring". This feature of the present invention protects the utility worker from the hot stick whipping around in the worker's hands due to a communication system command to operate the switch which obviously could be dangerous. Another aspect of the present invention provides that certain lock out system operation indicia can be used comprising decals that are covered or exposed during the safety cover opening and closing and during engaging and disengaging a locking lever to help guide the utility worker for proper safe switch manual lock out system operation. When the switch blade has been opened manually, the lock out lever can be manually flipped or rotated into its lock out position with the hot stick, thereby preventing motor operation or manual operation from reclosing the switch. The manual operation safety cover may be closed at this time, but the main switch motor is still disconnected from the battery due to the magnet and magnet sensor switch arrangement that works in conjunction with the rotation of the lock out lever and that opens the main switch motor circuit when the lock out lever is in the locked position. If the open switch motor is no longer energized then the switch's housing can now be removed to allow resolution of the malfunction of the switch without concern of the switch motor starting resulting in a safety issue.

These and other aspects of the present invention will be further understood from the detailed description of the particular embodiments, drawings and claims, using a side break type switch as an example, but this invention can be applied also to other types of switches such as a vertical break type and a double break type switch.

DETAILED DESCRIPTION OF THE PARTICULAR EMBODIMENTS

Figure 1A:
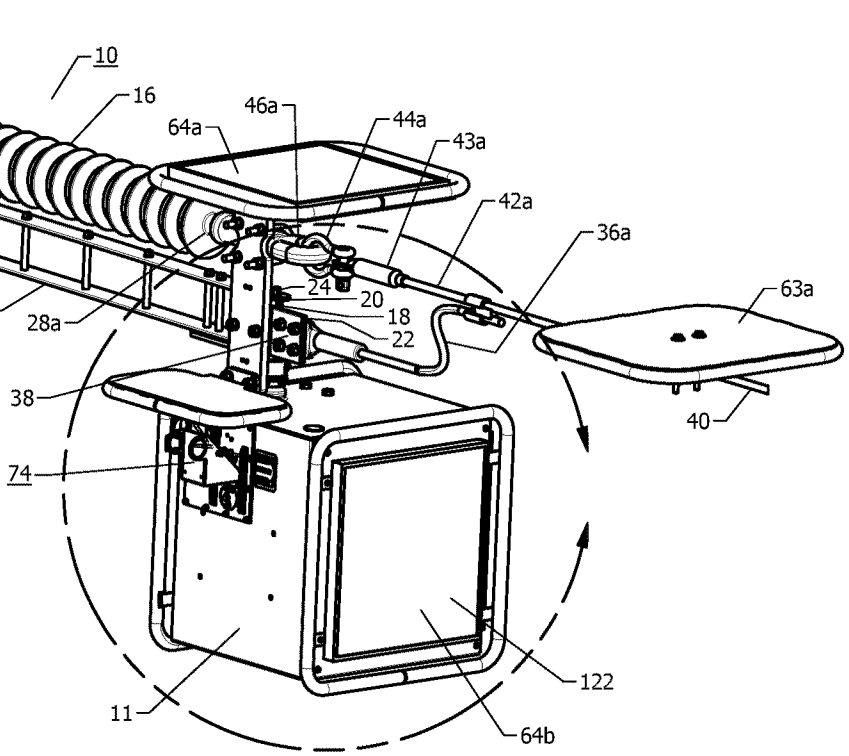
FIG. 1A is a perspective view of a communication system controlled motorized in-line disconnect switch of the present invention shown in a side break type disconnect switch configuration by way of example, showing the switch in the closed position.
Figure 1B:
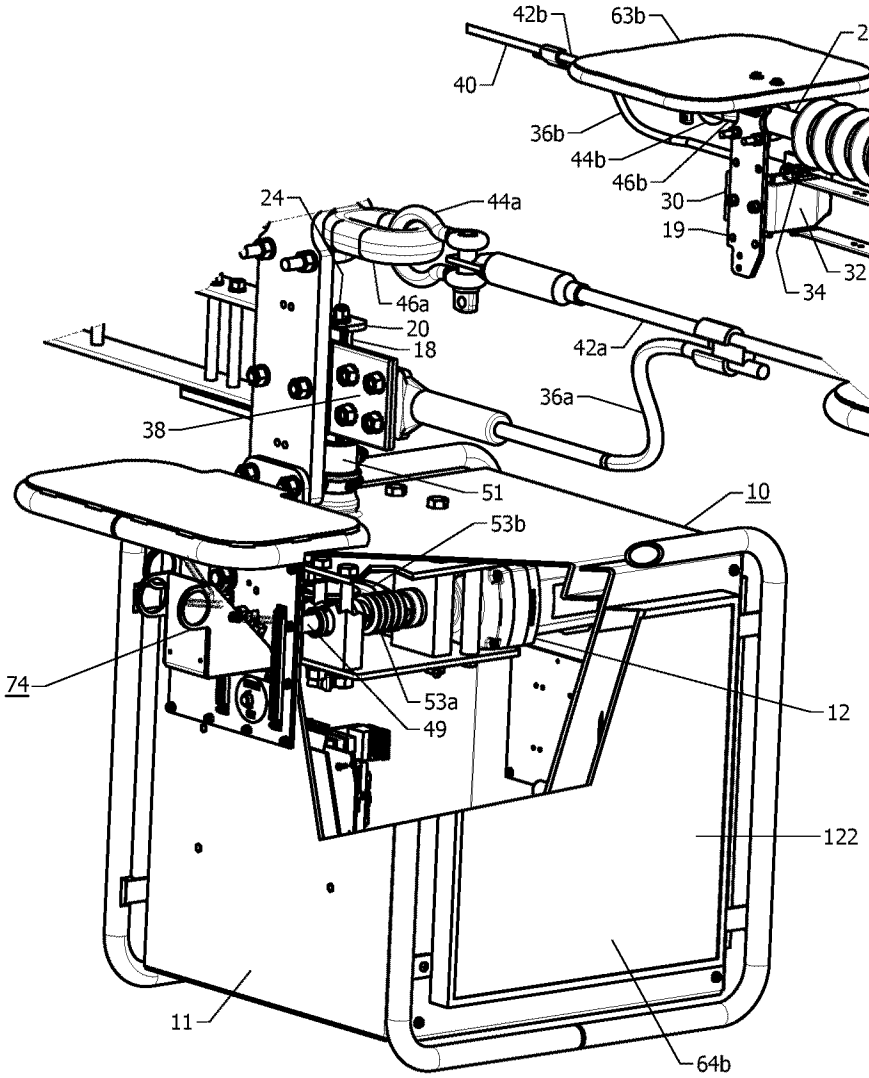
FIG. 1B is a cut away view of the present invention in-line disconnect switch shown in FIG. 1A, showing the switch blade drive motor and switch blade gear drive.
Figure 6:
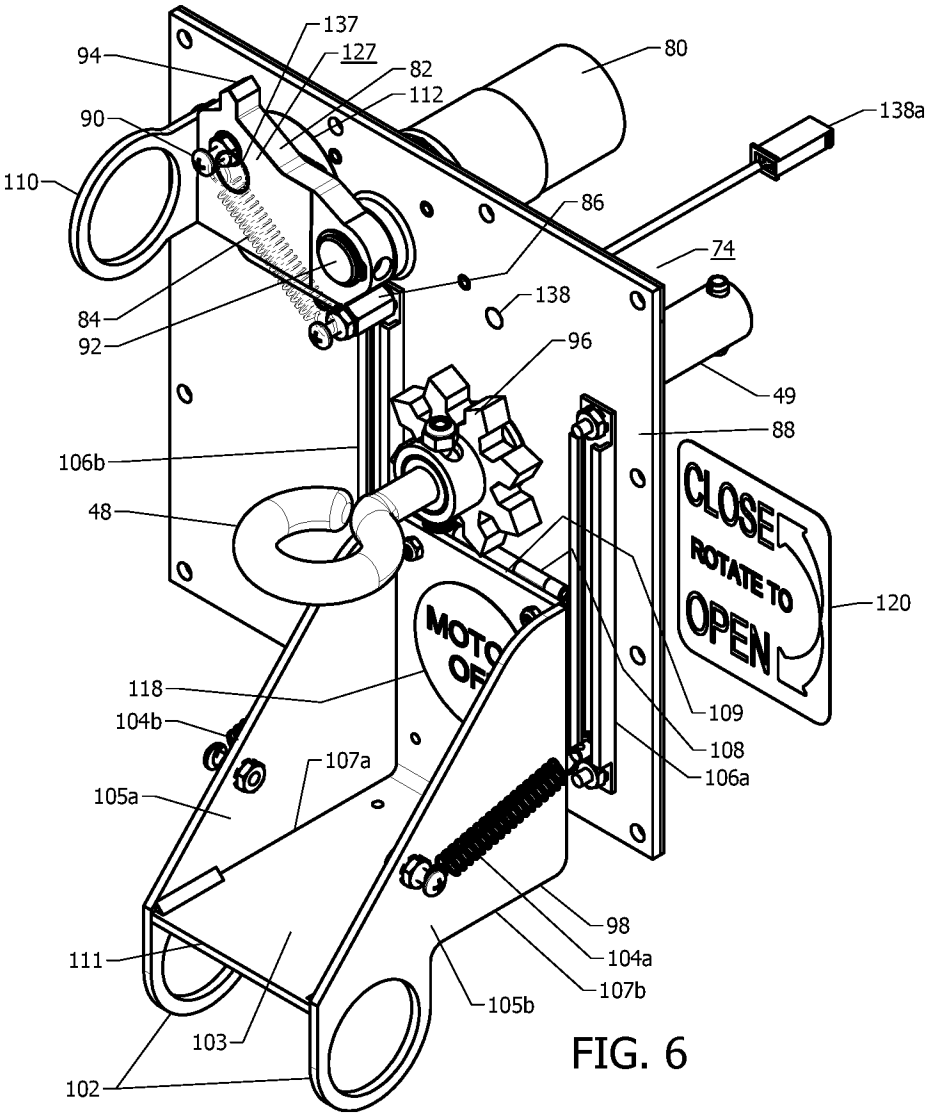
FIG. 6 is the same as FIG. 4A, but the lock out assembly has the spring loaded safety cover open and actuating the main motor shut off safety switch that disconnects the switch blade drive motor from the switch battery.
Figure 8:
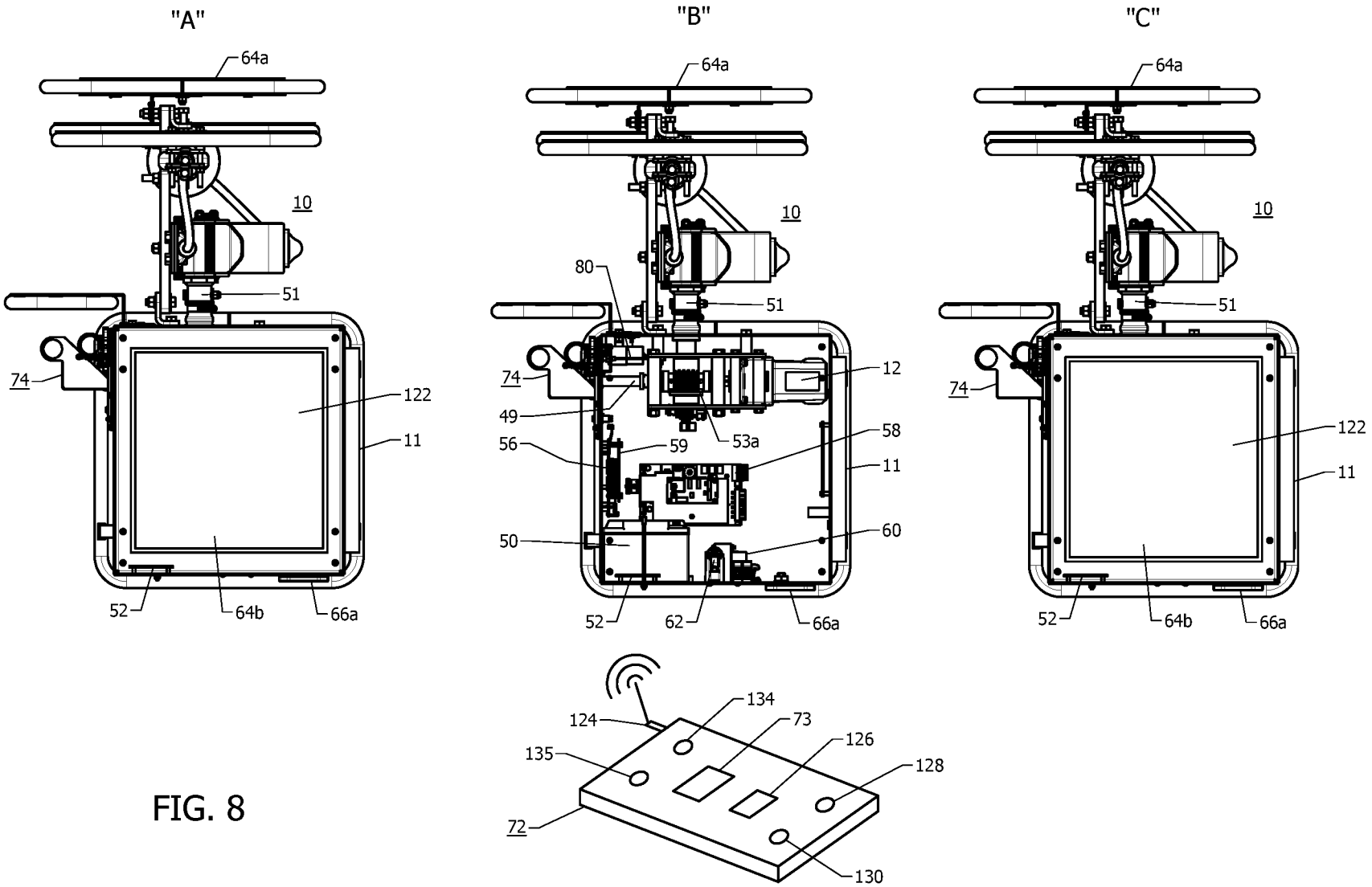
FIG. 8 is a schematic showing the present invention in end view for a side break disconnect switch configuration by way of example, operatively arranged in each of the phases "A", "B", and "C" of the electric system with a hand-held controller communication device controlling both the switch blade drive motor and the lock out motor which is operatively connected to the lockout lever of each of the switches, the end panel of the housing of phase "B" has been removed; and, FIG. 9 is the same as FIG. 8, but a control room communication device is controlling the switch blade drive motor and lock out motor connected to the lockout lever of each of the switches of phases "A", "B", and "C", the end panel of the housing of phase "B" has been removed.
Figure 9:
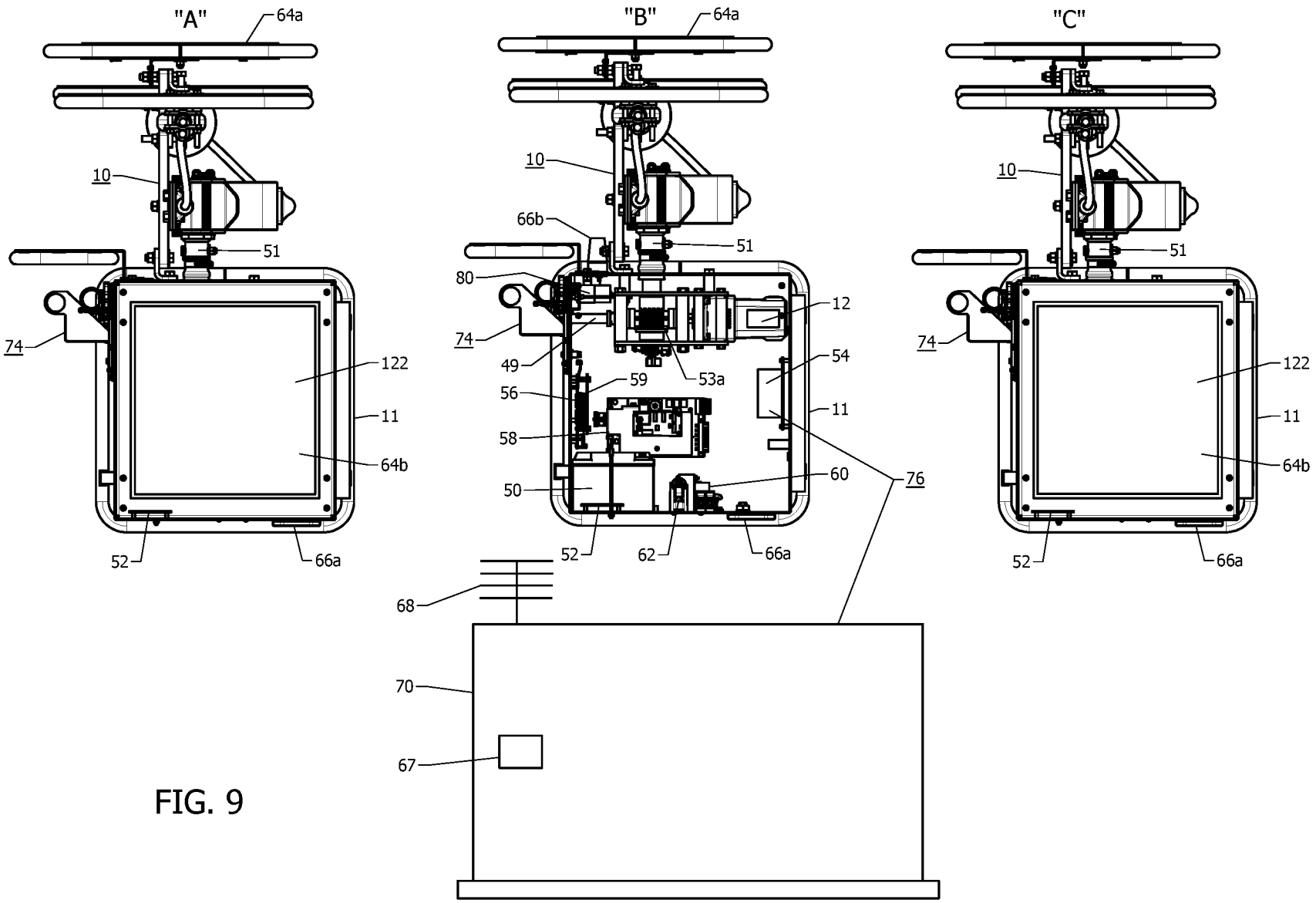

With reference to FIGS. 1A, 1B, 2 and 3 a communication system controlled motorized in-line high voltage air break disconnect switch 10 of the present invention is shown. In this embodiment a side break high voltage disconnect switch is depicted. Of course this invention is applicable to other types of communication system controlled motorized in-line high voltage air break disconnect switches including vertical break switches as referenced in said U.S. Pat. No. 9,881,755 B1 and U.S. Pat. No. 9,966,207 B1 and double break type switches referenced in said U.S. patent application Ser. No. 16/271,795. FIG. 1B depicts the switch 10 with the housing 11 enclosing a switch blade drive motor 12. The housing 11 is partially broken away to reveal the switch blade drive motor 12 and certain other components described subsequently. Reference should also be made to FIGS. 8 and 9 in this regard. The communication system controlled motorized in-line side air break switch 10 of the present invention depicted in FIGS. 1A, 1B, 2 and 3 is a wireless remote control system which may be operated by radio communication like the communication systems as disclosed in said U.S. Pat. No. 9,881,755 B1 and U.S. Pat. No. 9,966,207 B1 and U.S. patent application Ser. No. 16/271,795 except with certain additional novel features. These communication system controlled switches are an improvement over the previously described manually operated in-line vertical break disconnect switch, type ILO-C currently manufactured and sold by Cleaveland/Price Inc., of Trafford, Pa., the present Assignee. The communication system controlled in-line air break disconnect switch 10 of the present invention, in this embodiment, by way of example, includes the following components in common with the Cleaveland/Price Inc. type ILO-C in-line side break disconnect switch. As mentioned with the type ILO-C disconnect switch, it is manually operated by a hookstick, not shown in the Figures. The hookstick effort imparts rotation to the switch blade 14 for opening and closing the side break in-line disconnect switch 10, by rotation of an eye ring 48, such as shown in FIG. 6. The in-line disconnect switch 10 of the present invention utilizes the polymer strain insulator 16 and other switch current carrying parts of the Cleaveland/Price Inc. type ILO-C prior art switch.

Figure 2:
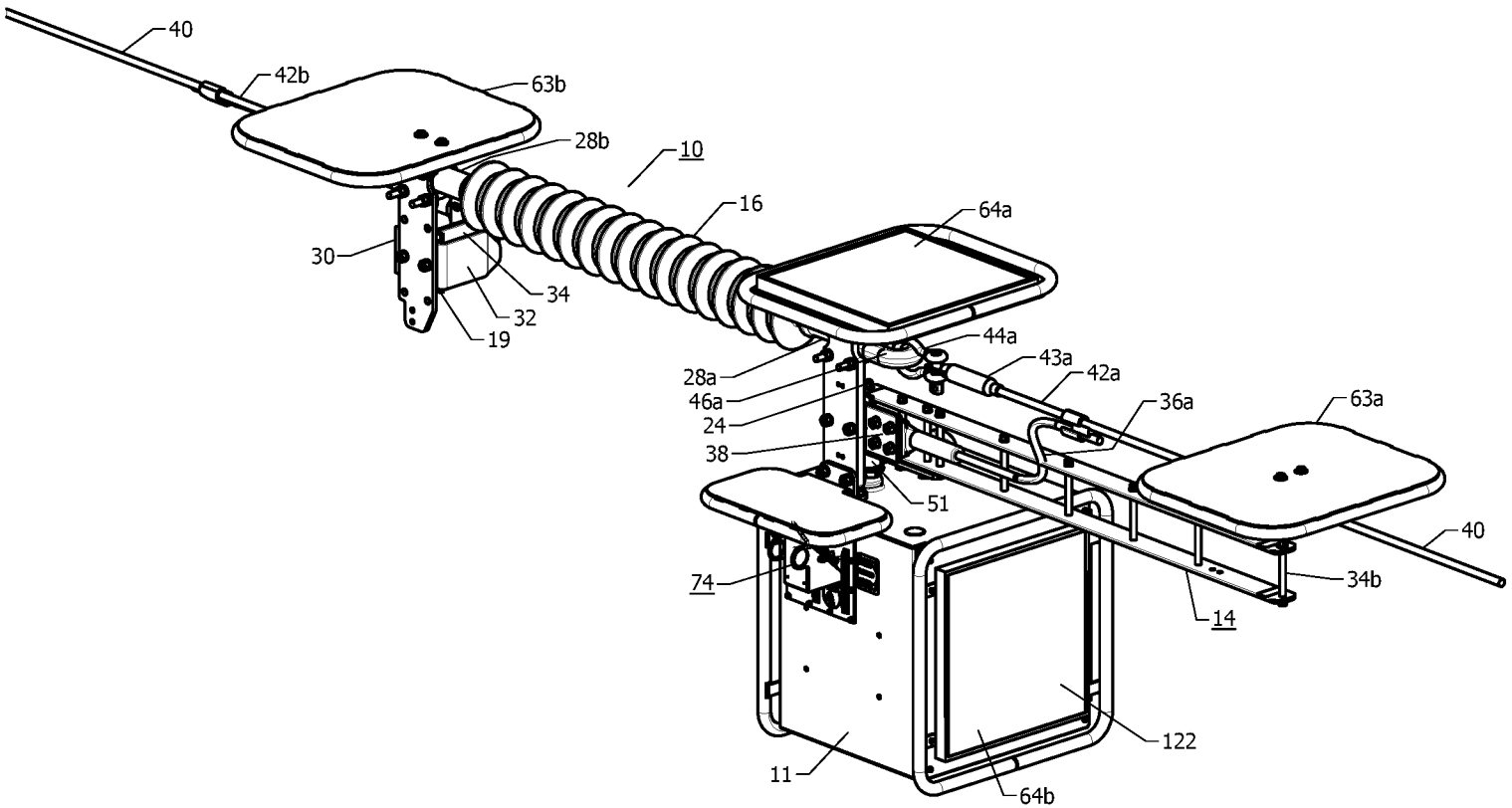
FIG. 2 is the same as FIG. 1A, but showing the switch in the open position.
Figure 3:
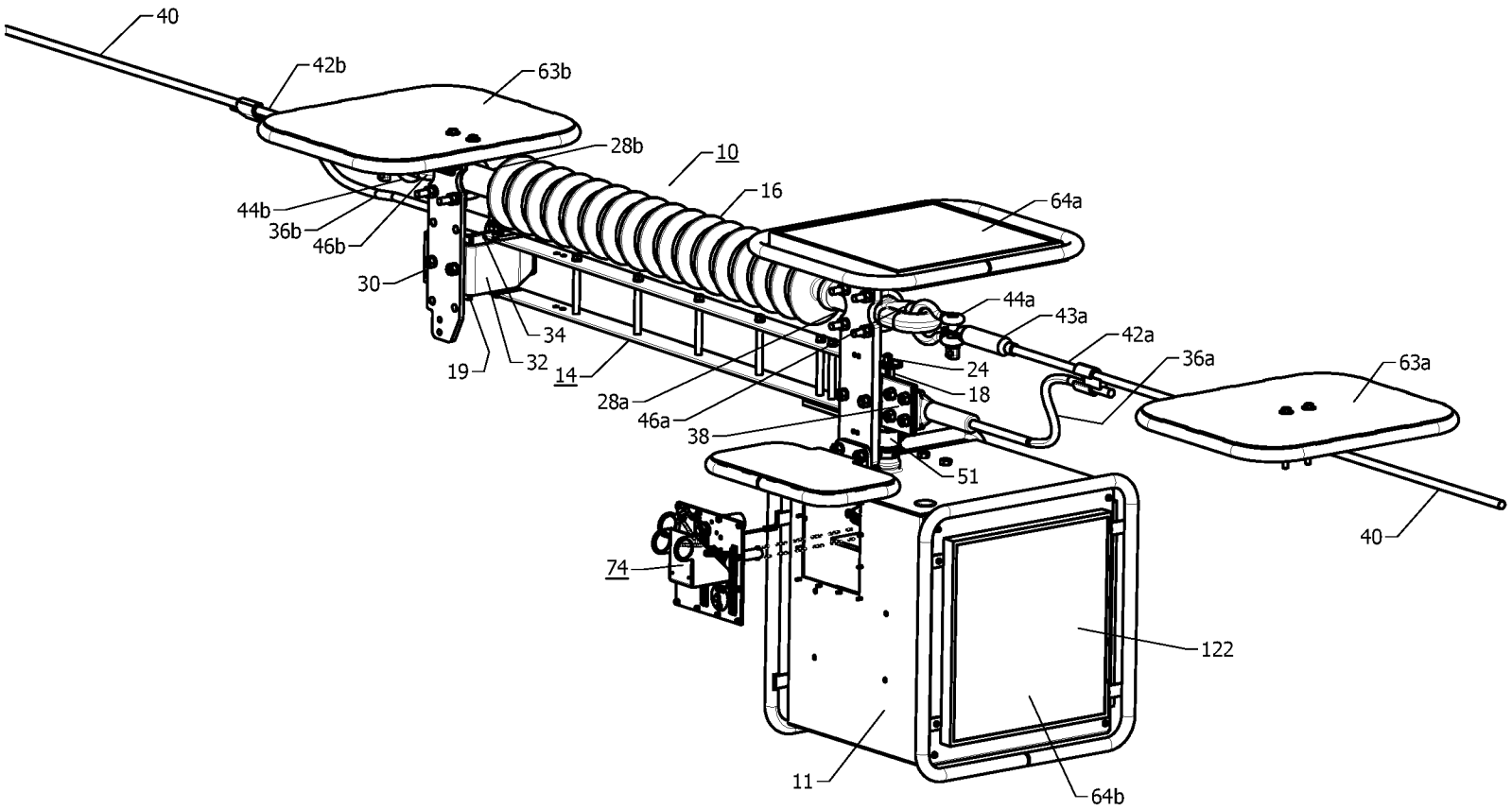
FIG. 3 is the same as FIG. 1A, but partially exploded, showing the lock out assembly as a separate unit positioned away from the motor gear drive assembly.

As shown in FIGS. 1A and 1B the other common switch current carrying parts included in this embodiment for a side break disconnect switch includes a hinge contact member 18 which is arranged at the hinge end 20 of the switch 10 and is connected in circuit to a hinge terminal 38. The hinge contact member 18 includes a hinge pin 24 that switch blade 14 rotates about. The hinge end 20 of the switch 10 is mounted proximate one end 28*a* of the strain insulator 16. The switch 10 also includes a break jaw end 19 and a switch break jaw contact terminal 30 which are mounted proximate the other end 28*b* of the strain insulator 16. The switch break jaw contact terminal 30 includes an integral break jaw contact 32 for contacting the switch blade end 34 when the switch 10 is closed. The switch 10 also includes jumpers 36*a*, 36*b* attached in the circuit respectively, to the hinge terminal 38 and the switch break jaw terminal 30. As shown in FIG. 1A, a transmission line 40 has been cut, resulting in two transmission line ends 42*a*, 42*b*. Each transmission line end 42*a*, 42*b* is respectively attached to strain cable fittings 43*a*, the other fitting is not shown in the drawings, and to shackles 44*a*, 44*b*. The present invention applies to high voltage electric power lines including transmission lines and distribution lines, for example. The shackles 44*a*, 44*b* respectively engage chain eye end fittings 46*a*, 46*b* at the ends 28*a*, 28*b* of the strain insulator 16. The transmission line 40 may support and suspend the in-line side break disconnect switch 10 without the switch 10 being attached directly to a dedicated support structure, such as metal framework. The jumpers 36*a*, 36*b* carry the transmission line current in circuit with the switch blade 14 via the contacts 32 and 18. Ice shields 63*a* and 63*b* protect the switch contacts from ice build up as shown in FIG. 2.

Figure 7:
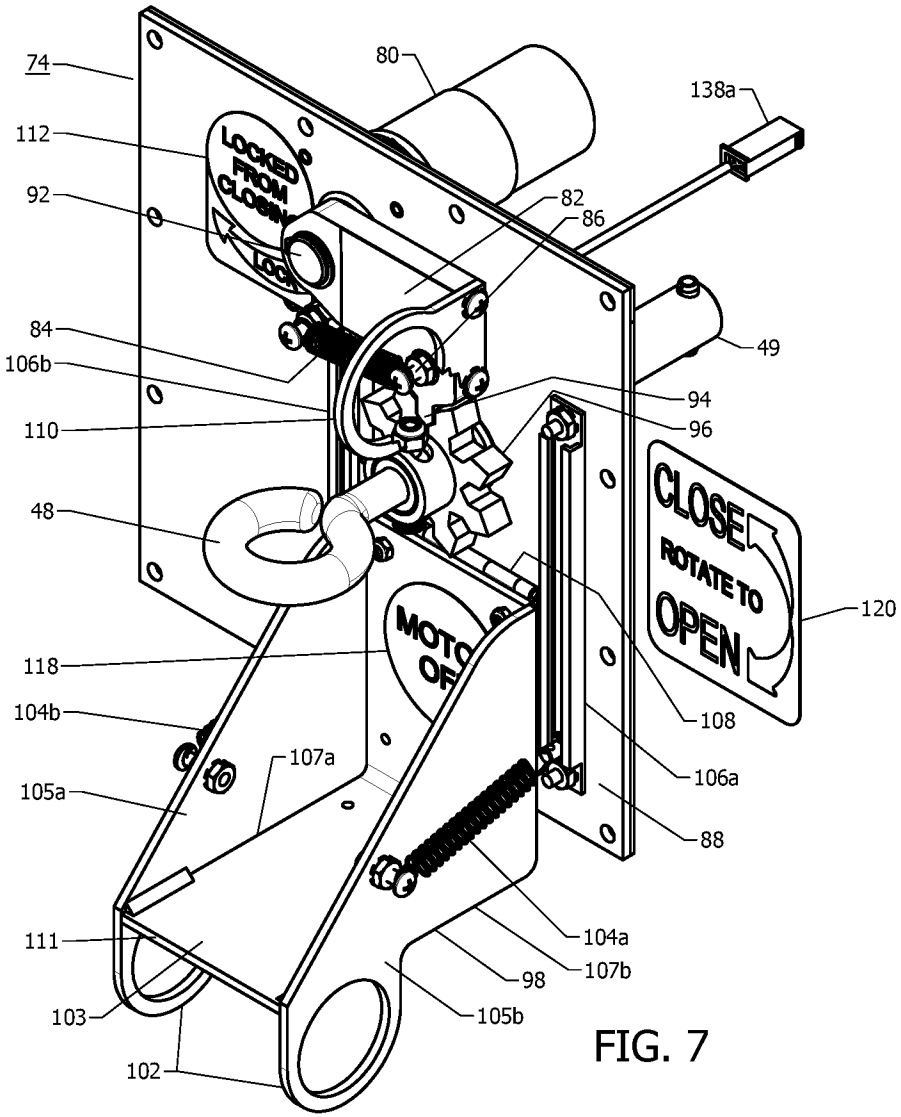
FIG. 7 is the same as FIG. 5, but the lock out assembly has the spring loaded safety cover open and actuating the switch blade drive motor shut off safety switch that disconnects the switch blade drive motor from the switch battery.

The communication system controlled motorized in-line side break disconnect switch 10 of the present invention in addition to these common current carrying parts with the type ILO-C in-line Cleaveland/Price Inc. air break disconnect switch also, includes the switch blade drive motor 12 which is housed in housing 11. As shown in FIG. 1B the switch blade drive motor 12 is operatively connected to a worm 53*a* which is bolted to drive shaft 49. The worm 53*a* drives gear 53*b* which causes a switch blade output shaft 51 to operate the switch blade 14 to rotate during opening and closing of the switch 10 when actuated by a communication system 76 as shown in FIG. 9. Not shown is the case of the switch blade output shaft 51 being connected to the motor by spur gears instead of a worm gear and the lockout assembly would attach to the gear drive shaft 49, in this case. Also, the gears can be replaced by a sprocket and chain drive, still keeping the intent of the invention. At the end of the drive shaft 49 is attached the eye ring 48 bolted to shaft 49, as shown in FIG. 6, for manual operation of the switch in case the switch blade drive motor is malfunctioning. The communication system 76 of the switch of the present invention may include a plurality of communication devices for communicating in the electromagnetic spectrum such as, for example, short range and long range radios, Bluetooth devices, cellular devices, satellite devices, microwave devices, Wi-Fi devices, infrared devices and/or optical devices. The embodiments of the present invention of the plurality of communication devices used to practice the present invention are depicted in the drawings and described as including short range and long range radios. One of ordinary skill in the art would recognize that Bluetooth devices, cellular devices, satellite devices, microwave devices, Wi-Fi devices, infrared devices and/or optical devices, can function as equivalents for and replace the short and long range radios described in the embodiments of the present invention without departing from the scope of the present invention. In view of this, the present embodiments of the communication system 76 may include a switch mounted short range communication device 52, such as a short range radio, and possibly a switch mounted long range device 54, such as a long range radio, Remote Terminal Unit 59 (RTU) mounted to a control board 56, a switch mounted short range antenna 66*a* and possibly a switch mounted long range antenna 66*b*, as can be seen, for example, by reference to FIG. 9 where the switch 10 in phase "B" has an end panel 122 removed to expose these components. Also, the communication system 76 may include a long range utility control room communication device 67, such as a long range radio, for communicating via a long range control room antenna 68 with the switch mounted long range radio 54, as shown in FIG. 9. The long range utility control room radio 67 is housed in a utility control room 70. Instead of the long range utility control room radio 67, the switch 10 may be operated by a handheld controller 72, as shown in FIG. 8, which carries an on board short range handheld controller communication device 73, such as a short range radio, which communicates with the switch mounted short range radio 52 via antenna 66*a* and handheld controller antenna 124 to operate the switch 10. Alternatively, as stated, the switch 10 may be operated manually by the eye ring 48, as shown in FIGS. 6 and 7, by being turned by a hookstick (not shown in the drawings), in the event the switch battery 50 is not functioning or other unforeseen issues cause a failure of the switch 10. The switch blade drive motor 12 can drive the gear drive arrangement 53*a*, 53*b* as described in more detail in the previously referenced U.S. Pat. No. 9,881,755 B1 and U.S. Pat. No. 9,966,207 B1.

The switch blade drive motor 12 may be controlled by communication system 76 as described in more detail in the previously referenced U.S. Pat. No. 9,881,755 B1 and U.S. Pat. No. 9,966,207 B1, which patents, as stated previously, are incorporated herein by reference in their entireties. The housing 11 as shown in FIGS. 1A and 1B, for example, is mounted at the hinge end 20 of the switch 10 as shown. Similar to these referenced patents, the communication system 76 of the present invention includes, the in-line high voltage disconnect switch 10 which can be powered by a solar charged battery 50 carried in the housing 11, as shown in FIGS. 8 and 9. The solar charged battery 50 powers the switch blade drive motor 12, and also the switch mounted short range radio 52 and possibly the switch mounted long range radio 54. The housing 11 also carries a power board 58, that takes power from solar panels 64*a* and 64*b*. The power board 58 charges the battery 50 at a rate that does not over charge the battery to run the motor 12 at 125 VDC. The power board 58 includes an inverter, not shown, that converts 12 VDC to AC. The housing 11 carries a transformer 60 that raises the voltage to 125 VAC which is rectified by the power board 58 to 125 VDC. The housing 11 carries fuses 62 to protect the circuit. The RTU 59 is mounted on the control board 56 and is a microprocessor-controlled electronic device that interfaces the switch control to a supervisory control and data acquisition system by transmitting telemetry data via the switch mounted radio to a master system, and by using radio messages from the supervisory system which are translated via the RTU 59, to operate relay contacts, not shown, on the control board 56 to energize the switch mounted motor 12 to open or close the switch. A remote terminal unit (RTU) such as manufactured and sold by Cleaveland/Price Inc. as model no. RTU 3212 may be used for this application. The transformer 60 and fuses 62 are also powered by the solar charged battery 50, as shown in FIGS. 8 and 9. On the exterior of the housing 11, one or more of the solar panels 64*a* and 64*b* for powering the battery 50 may be mounted as shown in FIG. 1A.

The improvement of the present invention provides the solution for the need for safety by providing a lock out system 74 as shown in FIGS. 1A-9 for the communication system controlled in-line motorized high voltage disconnect switch 10. The lock out system 74 can securely lock out the switch 10 from movement especially preventing an open switch 10 from closing. The lock out system 74 of the present invention includes the capability, as mentioned, to be operated by remote control for safe use of the switch 10.

The lock out system 74 of the present invention provides a system of mechanical, electrical and electronic devices that combine to provide a secure lock out feature for the communication system controlled in-line motorized high voltage disconnect switch 10 for both wireless remote control and manual control. The lock out system 74 may include a lockout motor 80 powered by the switch battery 50, as shown in FIGS. 4A, 4B, 5, 6, 7, and 9. Instead of a lockout motor and cooperating parts as subsequently described, a solenoid arrangement, not shown in the drawings, including a solenoid and cooperating parts could be used to operate a lock out lever. The lockout motor 80 is configured to actuate a lockout lever 82. The lockout lever 82 is spring loaded via lockout lever spring 84 which is mounted between a first lockout pin 86 mounted to a lockout base 88 and a second lockout pin 90 mounted on the lockout lever 82 as shown in FIG. 4A. The lockout lever 82 is mounted securely on a lockout motor shaft 92. The lockout lever 82 includes a locking tooth 94. The lockout system 74 includes a lockout gear 96 securely bolted and connected to the switch blade drive motor worm drive shaft 49 of the switch blade drive motor 12. Lockout lever 82 is configured with respect to the lockout gear 96 such that when the lockout lever 82 is actuated by the lockout motor 80, in order to lockout the switch 10, the lockout motor shaft 92 is caused to rotate towards the lockout gear 96 until the locking tooth 94 securely engages the lockout gear 96 to prevent the rotation of the switch blade drive motor 12 as shown in FIG. 5 with the eye ring 110 partially cut away to view the locking tooth 94 engaging the lockout gear 96. The lockout lever 82 may rotate through an angle of 180 degrees, for example. This lockout prevents an open switch 10 from closing.

When the lockout lever is in the locked position as shown in FIGS. 5 and 7, the switch blade drive motor 12 is also desirably electrically disconnected from battery 50 via a magnet sensor arrangement 127 which includes a magnet 137 carried by the lockout lever 82 and a magnet sensor 138 attached to the lockout base 88 as shown in FIG. 6. When the lockout lever 82 rotates to the lockout position the magnet sensor 138 senses magnet 137 and activates a magnet sensor switch 138*a* to electrically disconnect the switch blade drive motor 12 from the battery 50.

Figure 4B:
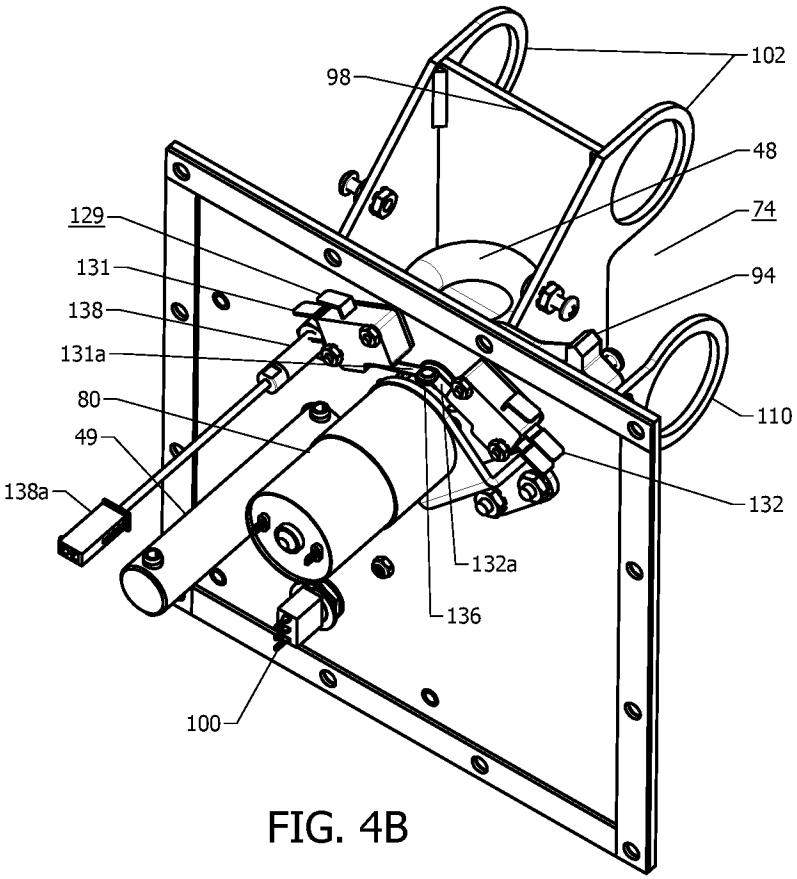
FIG. 4B is the rear view of the lock out assembly of FIG. 4A.
Figure 4A:
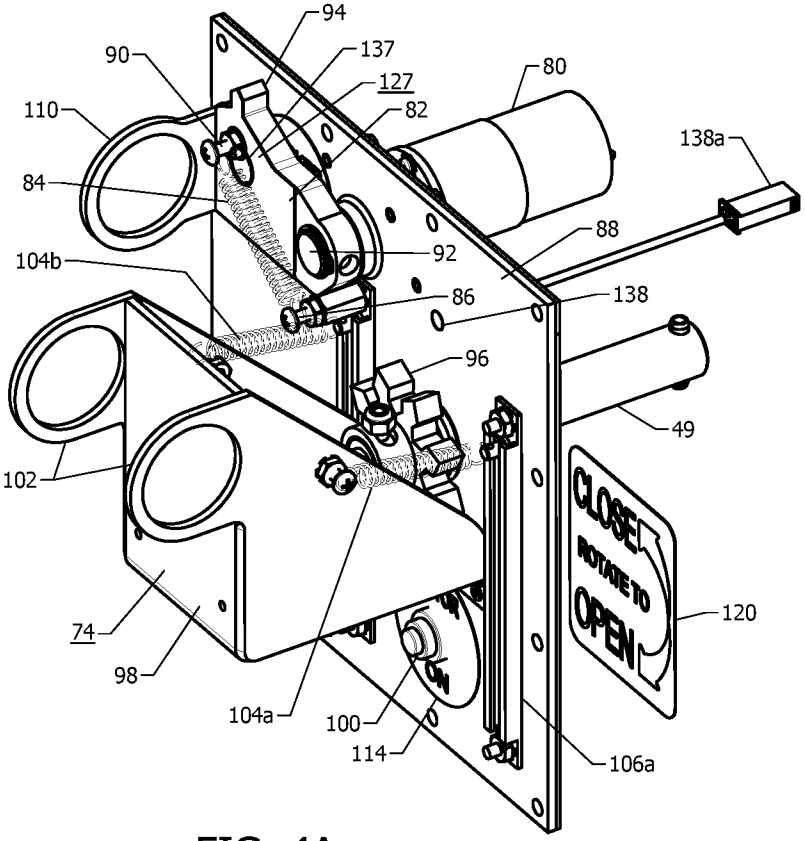
FIG. 4A is a perspective view of the lock out assembly in position such that the switch blade drive motor shaft is unlocked with the locking tooth of the lockout lever in the non-actuated unlocked position and showing a switch blade drive motor shut off safety switch that is operated when the eye ring cover is rotated to contact the switch blade drive motor shut off safety switch.
Figure 5:
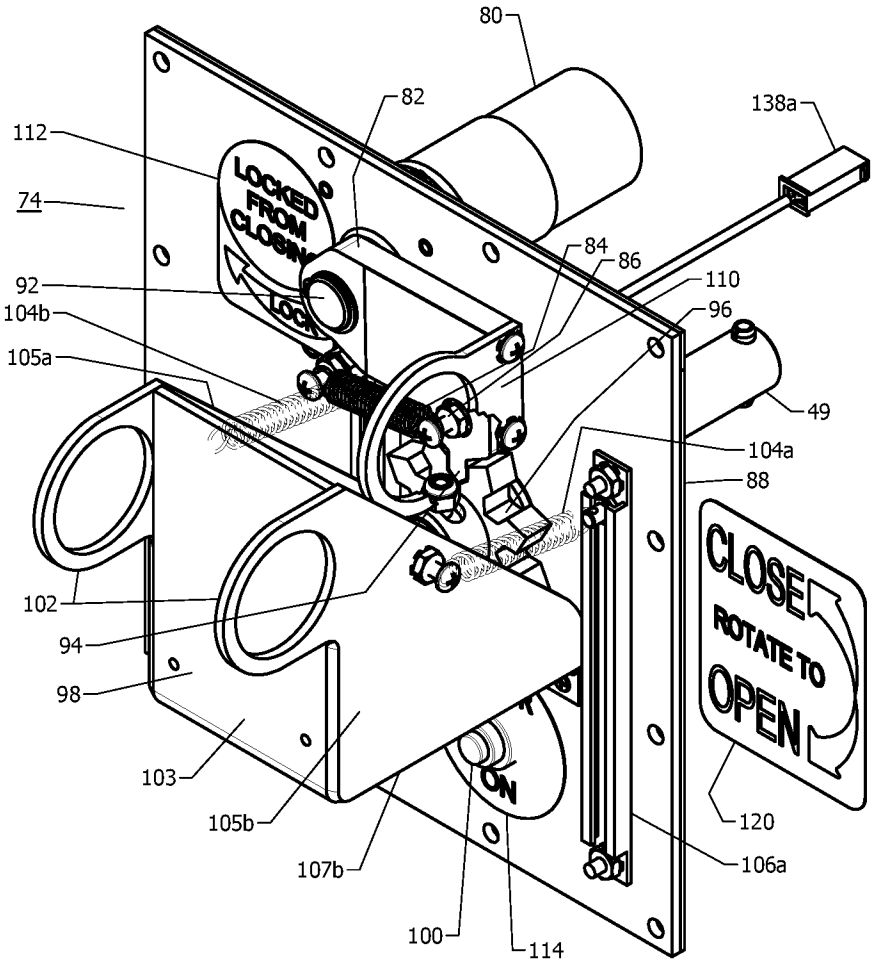
FIG. 5 with a cut away view is the same as FIG. 4A, but the lock out lever assembly is in position such that the switch blade drive motor drive shaft is locked with the locking tooth of the lockout lever in the actuated position engaging the locking gear attached to the switch blade drive motor drive shaft.

The lockout system 74 preferably also includes a micro switch arrangement 129 including micro switches 131 and 132, as shown in FIG. 4B, which define the travel of the lockout motor shaft 92. The micro switches 131 and 132 function as follows. The lockout motor shaft 92 has a screw head 136 attached extending from the lockout motor shaft 92 that engages with one of the micro switch levers 131*a* or 132*a* upon rotation of the lockout motor shaft. When the lockout motor 80 is commanded by a radio signal to lock the switch blade drive motor shaft 49 from rotating or to unlock the switch blade drive motor shaft 49 to permit its rotation, the lockout motor 80 rotates until the screw head 136 engages the appropriate micro switch lever 131*a*, 132*a* to stop the lockout motor travel for either the lock or unlock position of the lockout lever 82. The lockout lever 82 is commanded through the same communication system 76 including the same radios and Remote Terminal Unit 59 as used to initiate an operation of the switch 10 via switch blade drive motor 12 operation, but is given a distinctly different message to operate the lockout lever 82 to lock or unlock, compared to the switch blade drive motor 12 radio message. The radio message to operate the lockout lever 82 can be created and sent from a SCADA control center. SCADA which as mentioned previously is an acronym for Supervisory Control And Data Acquisition systems that monitor and control operations remotely. The radio message to remotely operate the lockout can be sent from the SCADA control center or can be sent locally from the handheld controller 72 whose accessibility is securely controlled by the utility. A "locked out" status message is then sent from the disconnect switch short range radio 52 if communicating to the handheld controller 72 or from the disconnect switch long range radio 54 if communicating to the long range utility control room radio 67.

The lockout system 74 thus far disclosed describes the operation of the lockout feature when all systems regarding the switch 10 are functioning correctly. As already mentioned, there may be a time when the battery 50 is inoperative or other unforeseen issues cause a failure of the switch 10 or remote controlled lockout motor 80 to operate, the utility will then need to send a bucket truck crew to the switch 10 to manually operate it. Also as mentioned the switch 10 already has a hot stick worm shaft eye ring 48 which is located at the end of the switch blade drive motor 12 drive shaft 49, as shown in FIG. 6, that allows the switch 10 to be opened or closed with a hot stick operated by a utility worker. Referring to FIGS. 4A, 4B, 5, 6, and 7, the present invention improves upon this feature of the switch 10 by providing a spring loaded eye ring safety cover 98 that normally covers the eye ring 48 in a closed position that prevents it from being operated by a hot stick. The hookstick eye ring safety cover 98 is attached to the lockout base 88 and may be configured to be rotatable about a lockout cover hinge 108 within a predetermined angular range of rotation such as 90 degrees, see FIGS. 5 and 6, for example. To access the hot stick eye ring 48 the spring loaded eye ring safety cover 98 must be flipped open first. The eye ring safety cover 98 when flipped open automatically engages and causes to operate a switch blade drive motor disconnect switch 100, i.e., the shut off safety switch, which disconnects the main switch blade drive motor 12 from the battery 52. The disconnect switch 100 may be a push button switch as shown in FIG. 4A, for example, which is water proof. The spring loaded eye ring safety cover 98 may include an L-shaped rectangular central wall 103 having a pair of triangular shaped side walls 105*a*, 105*b* attached to opposite side edges 107*a*, 107*b* of the L-shaped rectangular central wall 103. The spring loaded eye ring safety cover 98 may be mounted to the lockout base 88 by the lockout cover hinge 108 positioned at one end edge 109 of the L-shaped rectangular central wall 103, as can be seen in FIG. 6. A hookstick double eye ring 102 may extend from each of the triangular shaped side walls 105*a*, 105*b* proximate an other end edge 111 of the L-shaped rectangular central wall 103 as shown in FIGS. 5 and 6. The hookstick double eye ring 102 permits the spring loaded eye ring safety cover 98 to be flipped open as shown in FIG. 6 in a downward direction for the side break switch 10 with a hookstick or hot stick which is not shown in the drawings. The hookstick double eye ring 102 permits grasping by a hookstick from either the left side or the right side of the safety cover 98. Of course one eye ring would also be feasible. The spring loaded eye ring safety cover 98 may include a first cover spring 104*a* and a second cover spring 104*b*. One end of each cover spring 104*a*, 104*b* is attached to the spring loaded eye ring safety cover 98, as shown in FIG. 6, for example. The other end of spring 104*a* rides in a first track 106*a* attached to the lockout base 88 and the other end of spring 104*b* rides in a second track 106*b* attached to base 88. As can be seen by reference to FIG. 5, once the hookstick eye ring safety cover 98 is in the closed position as shown, the springs 104*a* and 104*b* have traveled to the top of the respective first track 106*a* and second track 106*b* to maintain the hookstick eye ring safety cover 98 in the closed position until the safety cover 98 is rotated by a hookstick, which is not shown in the drawings, to the open position as shown in FIG. 6. In the open position shown in FIG. 6 the springs 104*a* and 104*b* have traveled to the bottom of the respective first track 106*a* and second track 106*b* to maintain the hookstick eye ring safety cover 98 in the open position as shown in FIG. 6 with the safety cover 98 now automatically engaging and causing to operate the switch blade drive motor disconnect switch 100 which maintains the push button depressed and disconnects the main switch blade drive motor 12 from the battery 52 while hot stick turning the "eye ring", as previously mentioned.

In a further aspect of the improvement of the present invention, the lockout lever 82 can be provided with an attached hookstick single eye ring 110 extending perpendicularly from the locking lever 82, for example, as shown in FIGS. 4A, 5, 6 and 7. The hookstick single eye ring flange 110 may be engaged by a hookstick, not shown in the drawings, to manually engage and disengage the locking tooth 94 from the lockout gear 96. The lockout lever 82 in this case may also rotate through an angle of 180 degrees, for example. When lock out lever 82 rotates to the locked position from the unlocked position as shown in FIG. 6, the magnet 137 on the lockout lever 82 rotates as mentioned to be near the sensor 138 actuating magnet sensor switch 138*a* giving a radio status to the control room 70 indicating that the device is now locked and also opens the circuit to the switch blade drive motor 12 for assurance that the switch blade 14 will not close when the switch 10 is locked open. Therefore, the switch blade 14 has been mechanically and electrically locked open.

The lockout system 74 may be provided with operation indicia, i.e., safe operation decals, as mentioned previously. A first decal 112 "Locked From Closing" with an arrow at the bottom of the decal may be attached to the base 88 as shown in FIG. 5 with the arrow pointing the direction for locking the lockout gear 96. A second decal 114 indicating "Motor On" can be affixed to base 88 and surround the switch 100 button. This decal lets the utility person know that the motor 12 is electrically operational. A third decal 118 "Motor Off" may be attached to the inside of the spring loaded eye ring safety cover 98 as shown in FIG. 6. The third decal 118 becomes visible to confirm to the utility person that the switch motor 12 is off and not operational when the eye ring safety cover 98 is opened exposing the "eye ring 48". A fourth decal 120 "Rotate To Close Or Open" may be attached next to the base 88 on the housing 11 as shown schematically in FIG. 6 which directs the utility person to rotate the eye ring safety cover 98 to open or close it. These four decals help guide the utility person for proper safe operation of the lockout for manual lockout of the switch 10. When the switch blade 14 is opened manually, after the utility worker gets "clearance" from the control room to get permission to open and lock out the switch 12 so maintenance can be started on a de-energized line, the lockout lever 82 may be flipped into its lock out position via the second hookstick eye ring flange 110, thereby preventing motor operation or manual operation from reclosing the switch 10, the first decal 112 "Locked From Closing" which was hidden by the lockout lever 82 becomes visible as seen in FIG. 5. The spring loaded eye ring safety cover 98 may be closed at this time, but the switch blade drive motor 12 is still disconnected from the battery 50 by the lockout lever 82 continuing to actuate the magnet sensor 138 while it physically and electrically prevents the switch 10 from closing. Now that the switch is locked out, maintenance of the transmission line can be completed. The end panel 122 of the housing 11 can now safely be removed to allow resolution of any malfunction of switch 10 without concern of the switch motor 12 starting.

With reference to FIG. 8, three side break disconnect switches 10, are operatively arranged in each of the phases "A", "B", and "C" of the electric system. As can be seen each switch 10 includes the lockout system 74 attached to the housing 11. The lockout system 74 as mentioned may be operated by a hand-held controller 72 which may include a handheld onboard short range radio 73 for controlling both the switch blade drive motor 12 and the lockout motor 80. The handheld onboard short range radio 73 is housed within the handheld controller 72, as shown in FIG. 8. The portable wireless hand-held controller 72 transmits a signal via the onboard short range radio 73 and the handheld onboard antenna 124 to the three switches 10 to open or close all three switches in unison. The hand-held controller 72 also preferably includes a replaceable battery 126, as shown in FIG. 8. The hand held controller 72 may also include an open switch button 128 and a close switch button 130, for example. When the open switch button 128 is pressed it activates the onboard short range radio 73 to communicate with the switch mounted short range radio 52 of each of the three switches to open the three switches 10 in unison. When the close switch button 130 is pressed it activates the onboard short range radio 73 to communicate with the switch mounted short range radio 52 of each of the three switches to close the three switches 10. By pressing lockout button 134 on the handheld controller 72 activates onboard short range radio 73 to send a radio signal to short range radio 52 of each of the three switches to actuate the lockout motor 80 to rotate the lockout lever 82 of each switch in a clockwise direction so that the locking tooth 94 engages the locking gear 96 which locks the switch blade drive motor drive shaft 49 which locks the respective switch 10 open. By pressing lockout release button 135 on the handheld controller a radio signal is sent in a similar manner that actuates lockout motor 80 to rotate the locking lever 82 of each of the three switches in a counterclockwise direction to release the locking gear 96 so that the switch blade drive motor drive shaft 49 can rotate which unlocks the open switch. The portable wireless hand held controller 72 is carried by a trusted utility operator person. This embodiment allows the three switch mounted short range radios 52 to communicate via switch mounted antenna 66*a* and via hand held controller antenna 124 with the short range radio 73 mounted in the hand held controller 72 to allow local operation at ground level to actuate the three phases "A", "B", and "C" and the lock outs. The hand held control box or controller 72 transmits a radio signal via short range radio 73 and antenna 124 that is encrypted so "terrorists" or other unauthorized individuals can not duplicate a radio signal to operate the in-line high voltage disconnect switch 10. Such encryption may typically include 128 bits of encryption. It is of course essential that utility personnel keep the hand-held controller 72 in a secure place so that the switches are safe from unwanted operation.

With reference to FIG. 9, three side break disconnect switches 10 are operatively arranged in each of the phases "A", "B", and "C" of the electric system. As can be seen in FIG. 9 each switch 10 includes the lockout system 74 attached to the housing 11. The control room radio 67 can control both the switch blade drive motor 12 and the lockout motor 80 of each of the switches 10 via control room long range antenna 68 communicating to switch mounted long range antenna 66*b* and to long range switch mounted radio 54 mounted in the master switch "B". Then the master switch "B" communicates to phases "A" and "C" switches via short range antenna 66*a* and short range radio 52 to operate all three switches together in unison. A lockout motor 80 is connected to the lock out lever 82 of each of the switches 10 of phases "A", "B", and "C". Utility control room personnel can by the control room long range radio 67 cause the locking tooth 94 of the lockout lever 82 to engage the lockout gear 96 to lock out the switch blade drive motor 12.

The embodiments disclosed are merely some examples of the various ways in which the invention can be practiced and are not intended to limit the scope of the invention.

What is claimed is:

1. A high voltage in-line air break disconnect switch operatively supported and suspended by and mounted in-line with an electric power line conductor, the high voltage in-line air break disconnect switch including at least one elongated strain insulator operatively supported and suspended by the electric power line conductor, an elongated rotating switch blade extending in parallel spaced relationship with and supported by the at least one elongated strain insulator, the elongated rotating switch blade having an electric open circuit non-conductive position and an electric closed circuit conductive position;

a switch blade drive motor in operative arrangement with a gear drive configured to rotate the elongated rotating switch blade upon the actuation of the switch blade drive motor into operative electric closed circuit conductive switch position with at least one break jaw and configured to rotate the elongated rotating switch blade upon motor actuation into the electric open circuit non-conductive switch position, the gear drive including a switch blade drive motor shaft in operative arrangement with the switch blade drive motor having a hookstick eye ring affixed at an end of the switch blade drive motor shaft, the switch blade drive motor operatively attached to a housing mounted on the high voltage in-line air break disconnect switch;

a communication system including a plurality of communication devices configured to actuate the switch blade drive motor for causing the switch blade drive motor shaft to rotate in one direction for causing the elongated rotating switch blade to rotate into the electric closed circuit conductive switch position and configured to actuate the switch blade drive motor for causing the switch blade drive motor shaft to rotate in an opposite direction for causing the elongated rotating switch blade to rotate into the electric open circuit non-conductive switch position;

the high voltage in-line air break disconnect switch including a battery mounted in the housing connected in operative electrical circuit arrangement with and configured to power the switch blade drive motor and the communication devices carried by the switch;

an improvement which comprises a switch lock out system comprising:

the switch blade drive motor shaft carrying the hookstick eye ring including a lockout gear operatively affixed thereto;

an electric lockout motor including a lockout motor shaft, the electric lockout motor connected in operative electrical circuit arrangement with the battery, a lockout lever operatively affixed proximate an end of the lockout motor shaft;

the lockout lever having a locking tooth protruding from the perimeter of the locking lever in predetermined position, the lockout lever configured to rotate upon manual actuation or electrical actuation of the electric lockout motor in one direction to cause the locking tooth to engage the lockout gear to lock the switch blade drive motor from rotating and configured to rotate upon manual actuation or electrical actuation of the electric lockout motor in an opposite direction to cause the locking tooth to disengage the lockout gear to permit the switch blade drive motor to rotate;

at least one of the plurality of the communication devices of the communication system configured to electrically actuate the electric lockout motor to rotate the locking tooth to engage the lockout gear to lock the switch blade drive motor to prevent the switch blade from rotating or to disengage the lockout gear to permit the switch blade drive motor to rotate the switch blade.

2. The high voltage in-line air break disconnect switch of claim 1, further comprising the at least one of the plurality of the communication devices including a switch mounted short range radio, a handheld controller including an onboard short range radio configured to actuate the electric lockout motor by communication with the switch short range radio to engage the lockout gear to prevent the switch blade from rotating and configured to actuate the electric lockout motor to disengage the lockout gear to permit the switch blade drive motor to rotate the switch blade.

3. The high voltage in-line air break disconnect switch of claim 1, further comprising the at least one of the plurality of the communication devices including a switch long range radio, a utility control room having a control room long range radio configured to actuate the electric lockout motor by communication with the switch long range radio to engage the lockout gear to prevent the switch blade from rotating and configured to actuate the electric lockout motor to disengage the lockout gear to permit the switch blade drive motor to rotate the switch blade.

4. The high voltage in-line air break disconnect switch of claim 1, wherein the switch lock out system further including a magnet sensor arrangement including a magnet affixed to the lockout lever and a magnet sensor in operative arrangement with the magnet for sensing the proximity of the magnet and a magnet sensor switch in operative electrical circuit arrangement with the switch blade drive motor and configured to electrically disconnect the switch blade drive motor from the battery when the magnet sensor switch senses the lockout lever is in the locked position.

5. The high voltage in-line air break disconnect switch of claim 1, wherein the switch lock out system further includes a lockout base mounted to an exterior wall of the housing over an opening in the housing.

6. The high voltage in-line air break disconnect switch of claim 5, wherein the end of the switch blade drive motor shaft passes through an aperture in the lockout base, the lockout gear is attached to the switch blade drive motor shaft, exterior of the lockout base proximate the hookstick eye ring.

7. The high voltage in-line air break disconnect switch of claim 6, wherein the lockout motor is attached in predetermined position to the lockout base.

8. The high voltage in-line air break disconnect switch of claim 7, wherein the switch lock out system further comprises a hookstick eye ring cover in a closed position configured to cover the hookstick eye ring during normal switch operation to prevent a hookstick from engaging the eye ring and in an open position when the hookstick eye ring cover has been flipped open configured to actuate a blade drive motor shut off switch.

9. The high voltage in-line air break disconnect switch of claim 8, wherein the hookstick eye ring cover includes an L-shaped rectangular central wall having a pair of triangular shaped side walls each attached to an opposite side edge of the L-shaped rectangular central wall, a hinge positioned proximate one end edge of the L-shaped rectangular central wall in operative attachment to the lockout base, the hookstick eye ring cover configured to be rotatable about the hinge within a predetermined angular range of rotation.

10. The high voltage in-line air break disconnect switch of claim 9, wherein the hookstick eye ring cover includes a hookstick double eye ring protruding from each of the triangular shaped side walls proximate an other end edge of the L-shaped rectangular central wall for enabling operating the cover from the closed position to the open position.

11. The high voltage in-line air break disconnect switch of claim 10, wherein the hookstick eye ring cover is configured to be spring loaded to maintain the hookstick eye ring cover over the hookstick eye ring until a hookstick engages the first hookstick eye ring flange to open the cover.

12. The high voltage in-line air break disconnect switch of claim 11, further comprising a switch blade drive motor shut off switch having a switch shut off button protruding from the lockout base in predetermined position such that when the hookstick eye ring cover is flipped to the open position and spring loaded open the hookstick eye ring cover is configured to contact the switch shut off button to shut off power to the high voltage disconnect switch blade drive motor.

13. The high voltage in-line air break disconnect switch of claim 11, wherein the lockout lever further includes a hookstick single eye ring protruding perpendicularly from one edge of the lockout lever, the hookstick single eye ring is configured such that when the switch blade is opened manually the lockout lever can be flipped manually into its lockout position via the hookstick single eye ring to prevent the switch blade drive motor from operating remotely via the communication system and to prevent manual operation from reclosing the high voltage in-line air break disconnect switch using a hookstick.

14. A switching arrangement for a high voltage electric utility three phase system, including three high voltage in-line communication system controlled motorized air break disconnect switches of claim 2, each of the switches operatively arranged in one of the three phases, wherein the handheld controller is configured to open or close all three of the high voltage in-line communication system controlled motorized air break disconnect switches in unison, the onboard short range radio of the handheld controller is configured to actuate the electric lockout motor of each of the switches via the respective switch short range radio to engage the respective lockout gear to prevent the switch blade of each of the switches from rotating and configured to actuate the electric lockout motor of each of the switches to disengage the respective lockout gear to permit the switch blade drive motor of each of the switches to rotate each of the respective switch blades.

15. A switching arrangement for a high voltage electric utility three phase system, including three high voltage in-line communication system controlled motorized air break disconnect switches of claim 3, each of the switches operatively arranged in one of the three phases, wherein the control room long range radio is configured to control the switch blade drive motor and the lockout motor of each of the three high voltage in-line communication system controlled motorized air break disconnect switches by communicating to a long range radio carried by one of the three switches, the long range switch radio on one of the three switches is configured to communicate with the short range switch radio carried by each of the other two switches to open or close all three switches in unison, the control room long range radio is configured to actuate the electric lockout motor of each one of the three switches via the respective switch short range radio to engage the respective lockout gear to prevent the switch blade of each of the switches from rotating and configured to actuate the electric lockout motor of each switch to disengage the respective lockout gear to permit the switch blade drive motor of each of the switches to rotate each of the respective switch blades.

16. The high voltage in-line air break disconnect switch of claim 13, further including at least one printed safety indicia including a first printed safety indicia configured to become visible upon the lockout lever engaging the lockout gear, a second printed safety indicia configured to become visible when the lockout cover is closed, and a third printed safety indicia configured to become visible when the lockout cover is open.

17. The high voltage in-line air break disconnect switch of claim 13, wherein the first printed safety indicia denotes the switch is locked from closing.

18. The high voltage in-line air break disconnect switch of claim 13, wherein the second printed safety indicia denotes the switch motor is on.

19. The high voltage in-line air break disconnect switch of claim 13, wherein the third printed safety indicia denotes the switch motor is off.

20. The high voltage in-line air break disconnect switch of claim 1, wherein the lockout lever is configured to be spring loaded to maintain the locking tooth in operative engagement with the lockout gear when the switch motor is locked out.

21. The high voltage in-line air break disconnect switch of claim 1, wherein the switch lock out system further including a micro switch arrangement including two micro switches configured to control the travel of the electric lockout motor.

22. The high voltage in-line air break disconnect switch of claim 21, wherein each of the micro switches including a switch lever, the lockout motor having a screw head affixed to the lockout motor shaft for contacting the switch levers of each of the micro switches as the lockout motor shaft rotates for controlling the travel of the electric lockout motor.

* * * * *